United States Patent [19]

Vischer

[11] 4,005,562

[45] Feb. 1, 1977

[54] CONTAINER PACKER

[75] Inventor: Peter Vischer, Golden, Colo.

[73] Assignee: Coors Container Company, Golden, Colo.

[22] Filed: July 24, 1975

[21] Appl. No.: 598,825

[52] U.S. Cl. ..... 53/57; 53/243

[51] Int. Cl.[2] ..... B65B 5/06

[58] Field of Search ..... 53/48, 57, 60, 73, 242, 53/243

[56] References Cited

UNITED STATES PATENTS

| | | | |
|---|---|---|---|
| 3,455,434 | 7/1969 | Lorken | 53/61 X |
| 3,619,967 | 11/1971 | Alduk | 53/243 X |
| 3,805,484 | 7/1974 | Rossi | 53/242 X |
| 3,807,128 | 4/1974 | Bauer | 53/48 X |
| 3,858,381 | 1/1975 | Huber et al. | 53/242 X |

*Primary Examiner*—Leon Gilden

*Attorney, Agent, or Firm*—Bertha L. MacGregor

[57] ABSTRACT

Disclosed herein is a bottle packer apparatus for encasing bottles in a continuous operation, comprising a downwardly inclined case conveyor on which inverted cases are moved to a loading area, means at each side of the case conveyor contacting sides of the cases and moving them to loading position, and a bottle conveyor having a continually moving belt on which bottles are carried in a plurality of lanes to an area beneath the inverted case in the loading position, the belt continuing to move forwardly while a predetermined number of bottles enter the case in the loading position and other bottles accumulate rearwardly of the said case due to back pressure exerted by the loaded case against said accumulating bottles. The bottle conveyor speed is always equal to or faster than the case conveyor speed in order to provide for a continuous accumulation of bottles to avoid gaps.

10 Claims, 8 Drawing Figures

CONTAINER PACKER

BACKGROUND OF THE INVENTION

This invention relates to a container packer, particularly to bottle packing apparatus by which continuously moved bottles are encased in continuously moved inverted cases.

Heretofore food and beverage containers have been placed in open top cases or have been carried on moving conveyors to a stationary loading zone where inverted cases are dropped onto containers while they are stationarily supported in the loading zone. Such prior art packing procedures require intermittent interruptions of the conveyor and packer operations.

SUMMARY OF THE INVENTION

This invention relates to bottle packer apparatus, and more particularly to apparatus for packing unfilled bottles into cases provided with a plurality of smaller cartons or with divider means spacing the bottles from each other. In the embodiment shown and described herein, cases designed to contain 24 bottles are provided with four cartons each of which holds six bottles separated by dividers that are parts of the "six-pack" cartons. If six-pack cartons are not used, the 24 bottle cases may be provided with spacers which divide each into 24 separate spaces.

Unfilled bottles which have been washed and inspected, usually in a separate bottle washing plant, preparatory to being filled with beer or other beverages, must be transported or transferred to the brewery or other plant where the beverage is produced. Such transportation or transfer can be accomplished without encasing the empty bottles, but the packing method and apparatus of this invention has several advantages over the transfer of uncased bottles.

The apparatus comprises a case conveyor on which inverted cases are continuously moved in a downwardly inclined plane from an upper receiving end to a loading area adjacent the discharge end, means at each side of the case conveyor contacting the sides of the cases and moving them to the loading position, and a bottle conveyor having a continually moving belt on which bottles are carried in a plurality of lanes parallel to the direction of travel of the belt to an area beneath the inverted case in the loading position, the belt continuing to move forwardly while a predetermined number of bottles enter the case in the loading position and other bottles accumulate rearwardly of the case due to back pressure exerted by the loaded case against said accumulating bottles. The case conveyor comprises a stationary section and a movable section extending in continuation of the stationary section and includes a vertical post on which the movable section is pivotally mounted.

OBJECTS OF THE INVENTION

One of the objects of the invention is to provide bottle packing apparatus whereby clean bottles are placed neck down in clean cases preparatory to transporting or transferring the cases and contents to a bottle filling plant. This procedure has the advantage of providing the bottling plant with the number of clean cases required to receive the bottled product. Further, the cases utilized in this procedure are either provided with cardboard dividers separating individual bottles or with six-pack cartons which are divided by spacers between the bottles, whereby scratching of the bottle surfaces with consequent weakening of the glass is avoided during the transfer operation. Storage of excess bottles, cases and cartons at the bottling plant also is avoided.

Another object of the invention is to provide packing apparatus designed for continuous operation, whereby bottles are carried in multi-lane formation on a continually moving conveyor, toward a converging case carrying conveyor on which inverted cases are deposited on an appropriate number of bottles, in the conveyors converging area. The bottle conveyor speed is always equal to or faster than the case conveyor speed in order to provide for a continuous accumulation of bottles to avoid gaps. Following the placement of the cases on the bottles, the cases and contents are guided downwardly in a curved path to a lower horizontal plane where the cases assume their open top up, closed bottoms down, positions, with the bottle necks down.

When two cases have been filled they exert sufficient back pressure against the approaching empty bottles to assure a closely accumulated assembly of bottles in the adjacent area, ready for encasement, and at the same time the bearing of the accumulated bottles against the filled case prevents bowing of the leading end wall of that case in which packing is just being completed.

Another object of the invention is to provide pivotal mounting of a section of the case conveyor whereby said section can be raised to provide access to mechanism for repair, clearing obstructions and for other purposes.

Another object is to provide sensor means which control the mechanism in the event of malfunction resulting from absense of bottles in a lane or lanes, down bottles, or other faults. The operation of the apparatus is controlled by the speed of delivery of the cases by the case conveyor. Operation ceases automatically in the absence of a case at a predetermined place in the apparatus, any absence of bottles, or down bottles near the converging area.

Another object of the invention is to provide bottle separator means depending from supports above the bottle conveyor for spacing the bottles of one lane from the bottles of an adjacent lane. The separators protect the glass surfaces but do not hinder close accumulation of bottles as they approach the area of convergence with the cases being delivered by the case conveyor and placed on a predetermined number of the accumulated bottles.

Another object of the invention is to provide "thumping" means for causing six-pack cartons in the inverted cases to move downwardly in said cases into bottle receiving positions before they approach the loading area.

DESCRIPTION OF THE PREFERRED EMBODIMENT

Figure 1:
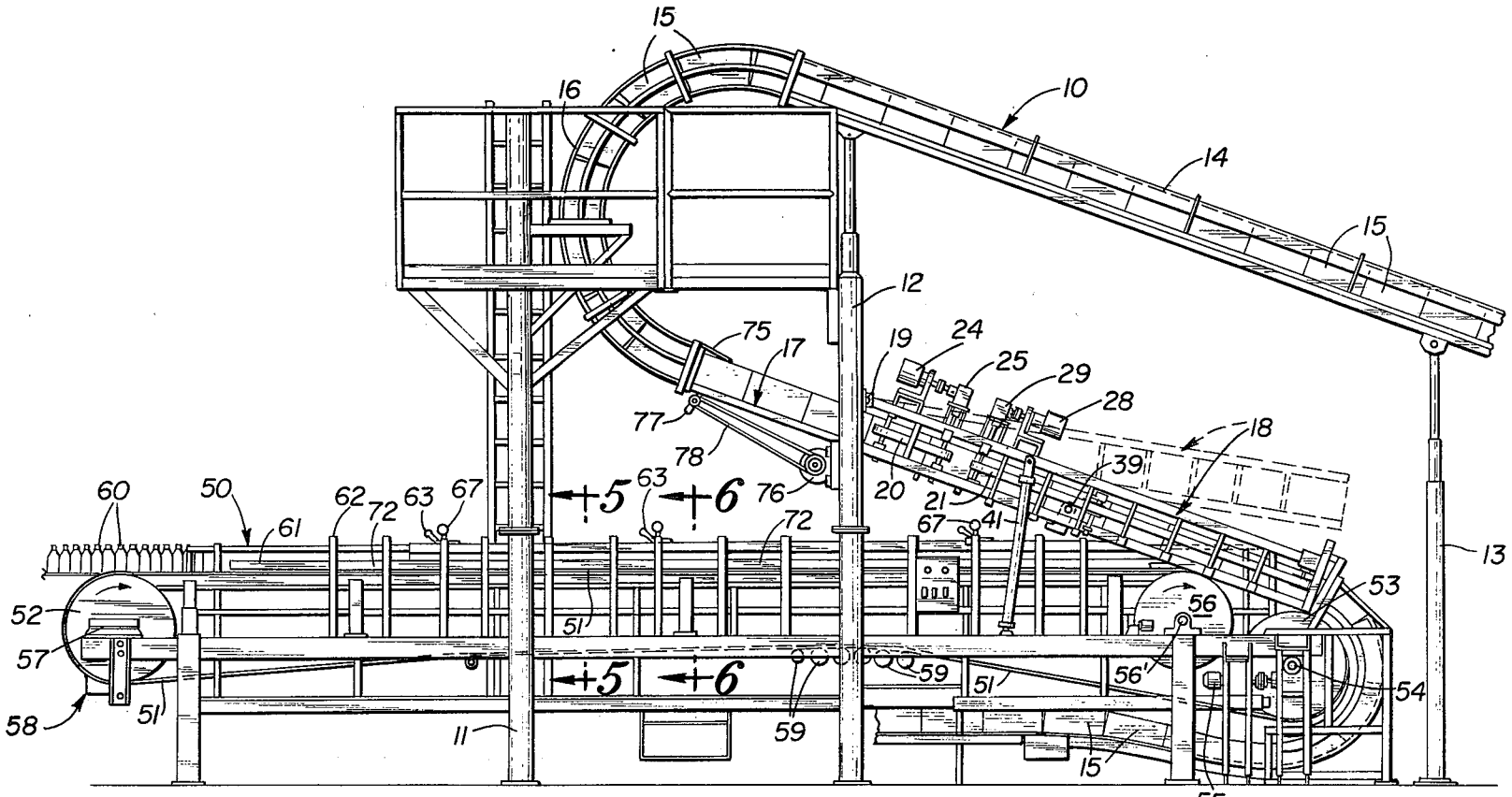
FIG. 1 is an elevational side view of bottle packer apparatus embodying the invention; showing the case conveying assembly and the bottle conveying apparatus.

In the embodiment of the invention shown in the drawings, a case conveyor 10 is supported by vertical posts 11, 12, 13. The upwardly inclined portion 14 of the case conveyor carries empty cases 15 to the infeed drop assembly 16 from which conveyor section 17 extends downwardly to the pivotally mounted section 18. Said section 18 is pivotally mounted at 19 on the post 12 in continuation with section 17. Conveyor section 18 has a partly open floor; cases 15 in this area are frictionally engaged by Poly-V belts 20 and 21 contacting the side walls of the cases. The belt 20 is driven by Poly-V sheaves 22 fixed on shafts 23, driven by motor 24 through a right angle drive unit 25. The belt 21 is controlled by Poly-V sheaves 26 fixed on shafts 27, driven by motor 28 through right angle drive unit 29. The shafts 23 and 27 are mounted in bearings fastened to a frame member 30 as shown in FIG. 2.

Figure 3:
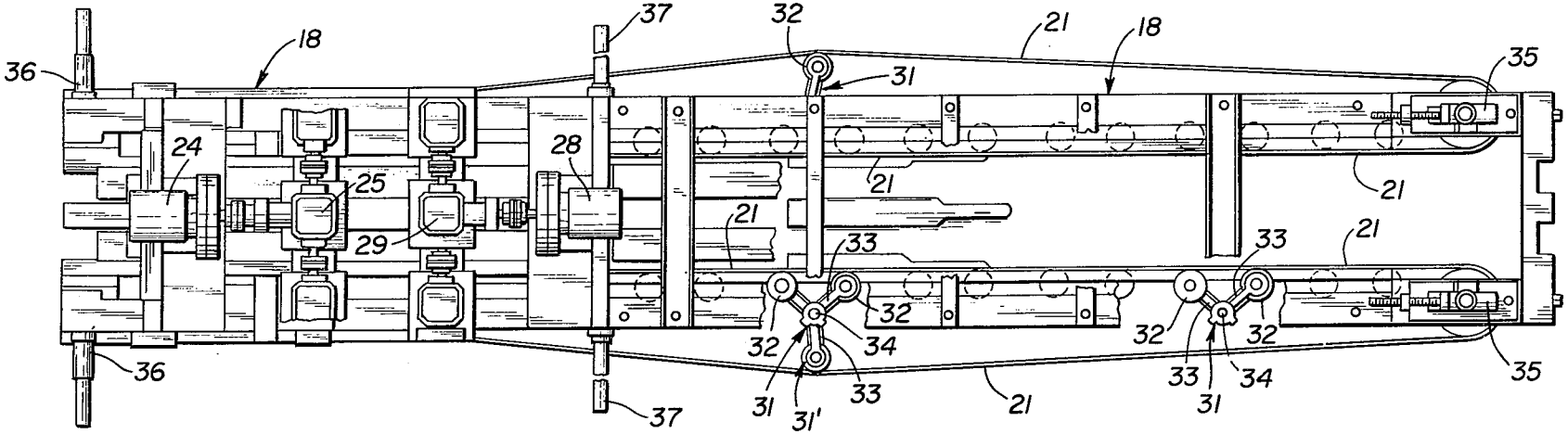
FIG. 3 is a top plan view of that part of the case conveying assembly shown in FIG. 2.
Figure 2:
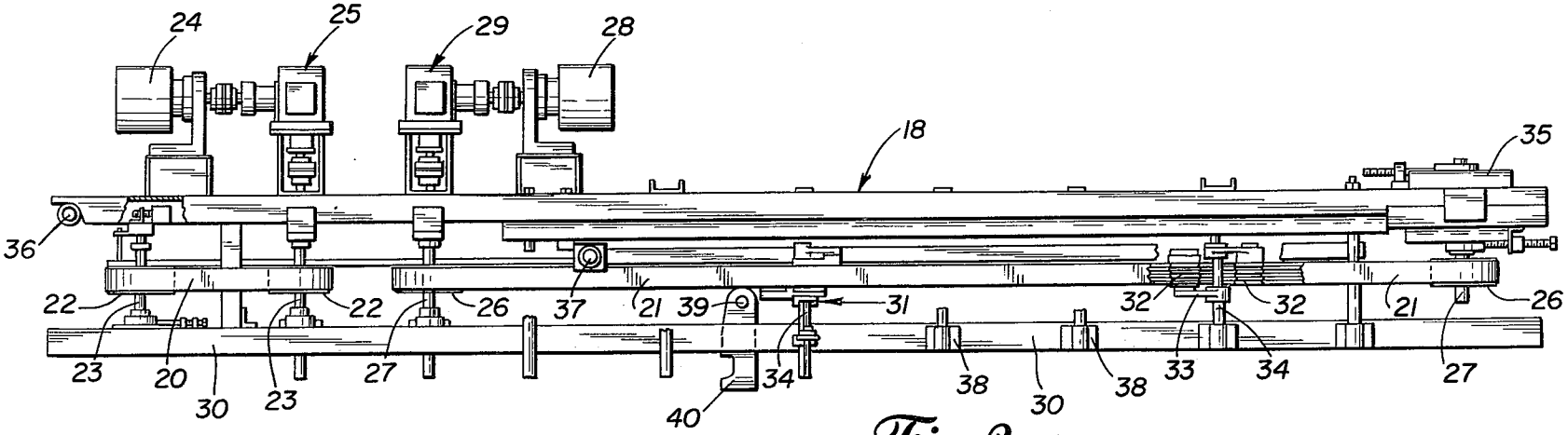
FIG. 2 is an elevational side view of part of the case conveying assembly of FIG. 1, on an enlarged scale.

The belt 21 is maintained in case contacting relationship by a plurality of drive tighteners 31, as shown in FIGS. 2 and 3, comprising Poly-V sheaves 32 and 31' loosely mounted on arms 33 on shafts 34. The drive tighteners 31 transmit controlled brake action to govern the speed of movement of the cases 15.

Take-up frames 35 and other frame members are shown but need not be described. A pivot shaft 36 is part of the pivotal connection 19 connecting the case conveyor section 18 to post 12. The lifting shaft 37 is actuated by the hydraulic cylinder 41 for raising and lowering the conveyor section 18 as shown in solid and broken lines in FIG. 1.

A case sensor 39 is mounted on a bracket 40 for detecting the absence of a case 15 on the conveyor section 18, for the purpose of causing automatic shutdown of the packer mechanism if cases are not moving in predetermined order.

Figure 8:
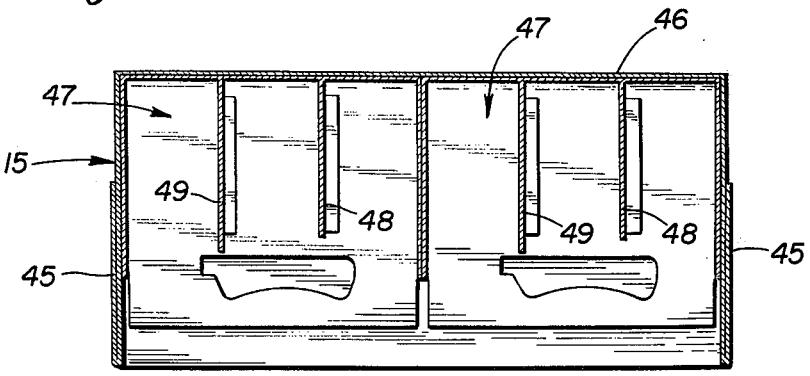
FIG. 8 is a longitudinal vertical sectional view of one of the cases employed in bottle packing by the machine of this invention, showing the case in its inverted bottom-up position, and showing in section two of four six-pack cartons in the case.

As shown in FIG. 8, the case 15 is conventionally shaped, with vertical side and end walls, with closing flaps 45 attached to the upper edges of said walls. The bottom 46 is closed. In the embodiment shown, the case contains four six-pack cartons each provided with a centrally located divider and two cross dividers, the divider 48 being shorter than the divider 49. As the cases move downwardly on conveyor section 18, the shorter dividers are toward the lead end of the case to facilitate loading.

Referring to FIG. 1, the bottle conveyor 50 comprises an endless conveyor belt 51 of carbon steel, 12 inches wide by 0.032 inches thick, 65 feet long, having two V-belts 51' on its lower surface. The belt 51 is trained over two pairs of C-section sheaves 52, 53, the sheaves 53 being mounted on motor shaft 54 driven by hydraulic gear motor 55. A drum 56 on shaft 56' supports the belt 51, engaging the lower surface of the belt between the V-belts 51'. Take-up bearings 57 are mounted adjacent the sheaves 52. A belt cleaning assembly 58 is provided, and six idlers 59 keep the belt 51 taut.

Figure 6:
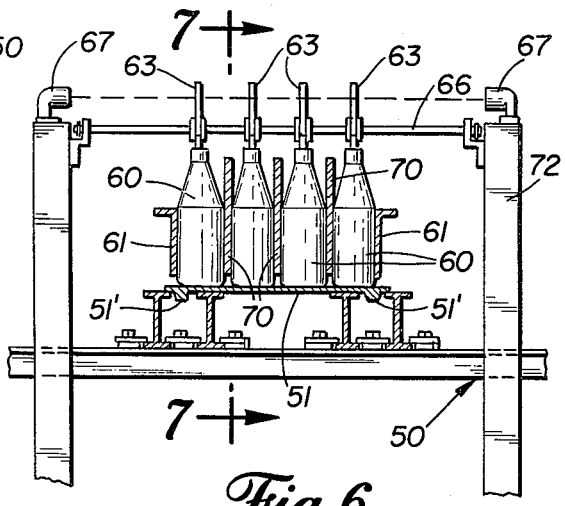
FIG. 6 is a transverse vertical sectional view in the plane of the line 6—6 of FIG. 1, on an enlarged scale.
Figure 7:
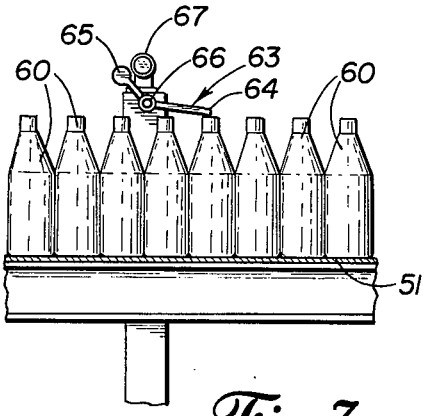
FIG. 7 is an enlarged detail of the bottle conveying apparatus, being a vertical sectional view in the plane of the line 7—7 of FIG. 6.

Bottles 60 are located in four parallel lanes between side rails 61. The tops of the bottles pass under cross bars 62, on which are mounted sensor flag assemblies 63 best shown in FIGS. 6 and 7. Each assembly 63 comprises a finger 64 and an arm 65 for intercepting a light beam. The finger 64 and integral arm 65 are pivotally mounted on the shaft 66. The fingers 64 contact bottles 60 in each of the four lanes. In the absence of a bottle in any lane, the finger 64 pivots downwardly and the light beam obstructor arm 65 moves upwardly into the path of the beam from the electric eye 67, causing cut-off of operation of the apparatus.

Bottle separators 70 are sheets of any suitable material depending from an attachment plate 71 on cross bar 62 between side supports 72. The separator attachment means are designated 73. Bottles are guided between the side rails 61.

Thumper apparatus for causing cartons 47 to move downwardly in the cases 15 into bottle receiving positions is mounted on the case conveyor section 17 and post 12, as shown in FIG. 1. It comprises a leaf spring 75, motor 76, cam 77 and belt 78. The cartons thus are moved downwardly from the FIG. 8 positions so that the handles are slightly below the edges of the inverted case 15. This facilitates encasement of the bottles in the inverted cases without distortion or other injury to the carton handles.

Figure 4:
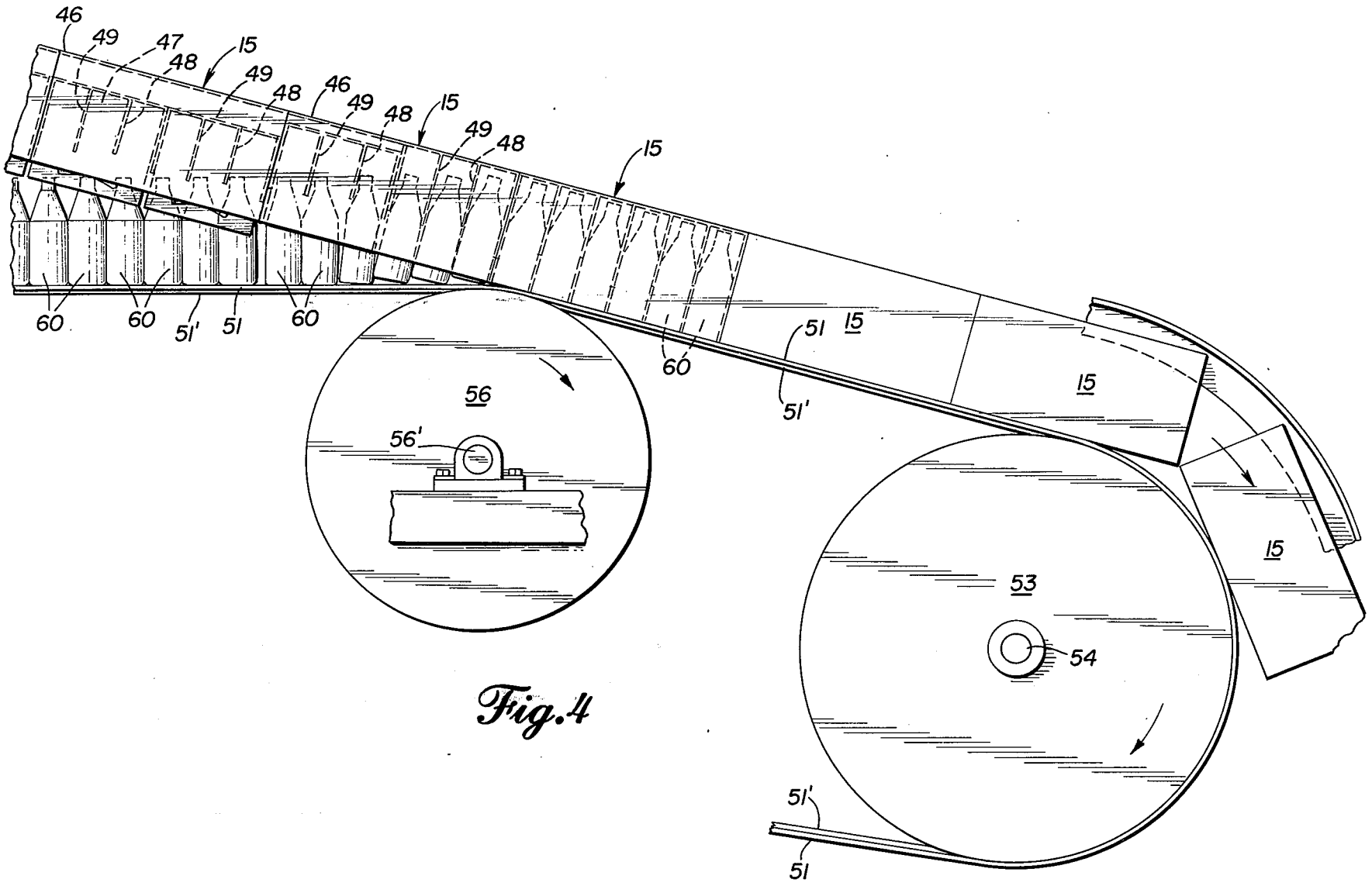
FIG. 4 is an elevational side view on an enlarged scale, of the converging portions of the case conveying assembly and the bottle conveying apparatus, showing completed encasement as well as cases about to be placed on accumulated bottles.
Figure 5:
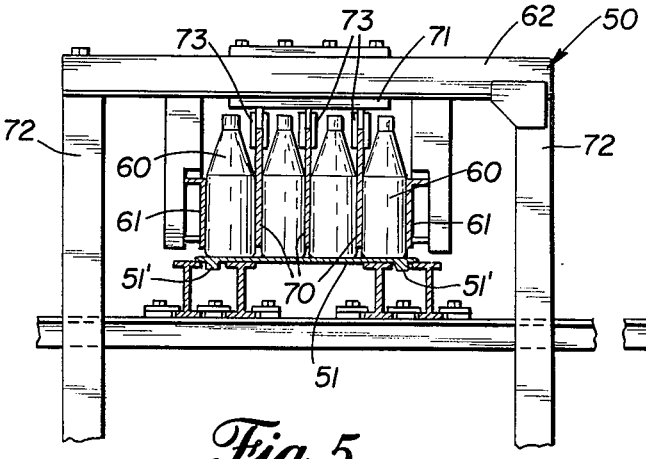
FIG. 5 is a transverse vertical sectional view in the plane of the line 5—5 of FIG. 1, on an enlarged scale.

FIG. 4 illustrates the placement of inverted empty cases 15 on accumulated bottles 60 on conveyor belt 51. The loading of the cases and the bearing of two loaded cases on the belt 51 just before they move to the discharge drop end of the conveyor produces back pressure to cause accumulation of bottles in close formation, ready for encasement, and simultaneously prevents bowing of the leading end wall of the loaded case against which the accumulated bottles exert pressure. The belt 51 moves continually, although momentarily bottle movement is slowed relatively to travel of the belt during the case loading, and thereby the accumulation of bottles in close formation is assured at the instant when a case is placed on the predetermined number of bottles just rearwardly of a loaded case. This apparatus and method make possible continuous encasement.

Loaded cases, bottoms up and bottle necks up, move into the curved drop at the end of section 18, and then onto the lower horizontal part of the conveyor, with case bottoms and bottle necks down, ready for subsequent operations.

I claim:

1. Bottle packer apparatus, in combination with cases provided with divider means which divide the cases into separate single bottle spaces, for encasing bottles in said cases in a continuous operation comprising a. a case conveyor on which inverted cases are moved in a downwardly inclined plane, said conveyor comprising a stationary section and a pivotally mounted section extending in continuation of the stationary section, b. means on the case conveyor contacting the side walls of the inverted cases and moving said cases to a position where the cases drop downwardly, and c. a bottle conveyor having a moving belt on which bottles are carried neck up in a plurality of lanes parallel to the direction of travel of the belt to an area beneath an inverted case which is dropped from the case conveyor, the bottle conveyor speed exceeding the speed of the case conveyor and causing accumulation of bottles adjacent one end of a loaded case.

2. Bottle packer apparatus defined by claim 1, in which the bottle conveyor belt travels continually while the loaded cases produce back pressure against bottles which accumulate rearwardly of a loaded case and prevent bowing of the case end.

3. Bottle packer apparatus defined by claim 1, in which the bottle conveyor belt continues to travel forwardly while a case is moving to loading position wherein a predetermined number of accumulated bottles enter the individual bottle spaces in the case, whereby other bottles accumulate adjacent the case being loaded and move in close formation toward loading position.

4. Bottle packer apparatus defined in claim 1, in which the pivotally mounted section of the case conveyor is movable away from the bottle conveyor into a raised position which provides access to the belt conveyor and movable parts on each of the belt and case conveyors.

5. Bottle packer apparatus defined by claim 1, which includes case thumping mechanism causing the case divider means to protrude downwardly from said cases before receiving bottles.

6. Bottle packer apparatus in combination with cases for encasing bottles in a continuous operation comprising a. a case conveyor on which inverted cases are moved in a downwardly inclined plane from an upper receiving end to a loading area adjacent the discharge end, b. a bottle conveyor having a moving belt on which bottles are carried in a plurality of lanes parallel to the direction of travel of the belt to an area beneath the inverted case, c. means dropping the cases upon the bottles, and d. said belt continuing to move fowardly while a predetermined number of bottles enter the case in the loading position and other bottles accumulate rearwardly of said case, the bottle conveyor speed exceeding the speed of the case conveyor and causing accumulation of bottles adjacent one end of a loaded case.

7. Bottle packer apparatus defined by claim 6, which includes divider means in the cases and case thumping mechanism causing said divider means to protrude downwardly from said cases before receiving bottles.

8. Bottle packer apparatus defined by claim 7, in which the case conveyor includes a stationary section and a pivotally mounted section, said pivotal section being movable away from the bottle conveyor into a raised position which provides access to the belt conveyor and movable parts on each of the belt and case conveyors.

9. Bottle packer apparatus defined by claim 7, which includes means at each side of the case conveyor contacting the side walls of the cases comprising a moving belt and a plurality of sheaves bearing on the belt and maintaining the belt in contact with the case side wall.

10. Bottle packer apparatus defined by claim 7, which includes side rails and raised cross bars above the bottle conveyor, and sensor devices to halt the machine in the absence of a bottle, pivotally mounted on the cross bars, said sensor devices comprising a finger extending downwardly to contact bottle tops, a light beam obstructor arm connected to the finger, and light emitting means, absence of a bottle in a lane actuating the finger and moving the light beam obstructor arm into beam intercepting position.

* * * * *